US010344990B2

(12) United States Patent
Baetens et al.

(10) Patent No.: US 10,344,990 B2
(45) Date of Patent: Jul. 9, 2019

(54) SET AND METHOD FOR ASSEMBLING A HEAT SOURCE UNIT

(71) Applicants: DAIKIN INDUSTRIES, LTD., Osaka-shi, Osaka (JP); DAIKIN EUROPE N.V., Ostend (BE)

(72) Inventors: Frans Baetens, Ostend (BE); Pieter Pirmez, Ostend (BE); Jan Vanooteghem, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 0 days.

(21) Appl. No.: 15/566,995

(22) PCT Filed: Apr. 15, 2016

(86) PCT No.: PCT/JP2016/002053
§ 371 (c)(1),
(2) Date: Oct. 16, 2017

(87) PCT Pub. No.: WO2016/166989
PCT Pub. Date: Oct. 20, 2016

(65) Prior Publication Data

US 2018/0128504 A1 May 10, 2018

(30) Foreign Application Priority Data

Apr. 17, 2015 (EP) ..... 15164038

(51) Int. Cl.
*F24F 1/02* (2019.01)
*F24F 11/89* (2018.01)
(Continued)

(52) U.S. Cl.
CPC ..... *F24F 1/022* (2013.01); *F24F 1/0003* (2013.01); *F24F 5/001* (2013.01); *F24F 11/30* (2018.01);
(Continued)

(58) Field of Classification Search
CPC ..... F24F 1/0003; F24F 1/022; F24F 5/001; F24F 11/46; F24F 11/89; F24F 2221/36; F24F 11/30
See application file for complete search history.

(56) References Cited

U.S. PATENT DOCUMENTS 5,967,761 A * 10/1999 Mehaffey ..... F04B 49/065 417/286

FOREIGN PATENT DOCUMENTS

WO WO 2011128755 A2 * 10/2011 ..... F24F 1/0003

OTHER PUBLICATIONS

International Search Report for PCT/JP2016/002053 (PCT/ISA/210) dated Jul. 14, 2016.

(Continued)

*Primary Examiner* — Marc E Norman
(74) *Attorney, Agent, or Firm* — Birch, Stewart, Kolasch & Birch, LLP

(57) ABSTRACT

A set for assembling a heat source unit of an air conditioner at the site of the air conditioner, includes a heat source heat exchanger module having a first casing, a heat source heat exchanger and a compressor module port fluidly communicated with the heat source heat exchanger, a compressor module having a second casing separate from the first casing, a compressor and a heat source heat exchanger module port fluidly communicated with the compressor, wherein the heat source heat exchanger module and the compressor module are fluidly communicatable via the compressor module port and the heat source heat exchanger
(Continued)

port, a main board comprising a control logic of the air conditioner and a first electric connector, wherein at least one of heat source heat exchanger and compressor modules has a circuit board comprising a second electric connector, the circuit board of such a module being configured for data communication with the main board upon electrical connection of the circuit board and the main board via the first and second connectors. Further, a method for assembling a heat source unit of an air conditioner at the site of the air conditioner uses such a set.

9 Claims, 8 Drawing Sheets

(51) Int. Cl.

| | |
|---|---|
| ***F24F 1/022*** | (2019.01) |
| ***F24F 1/0003*** | (2019.01) |
| ***F24F 5/00*** | (2006.01) |
| ***F24F 11/30*** | (2018.01) |
| ***F24F 11/46*** | (2018.01) |

(52) U.S. Cl.
CPC ..... *F24F 11/46* (2018.01); *F24F 11/89* (2018.01); *F24F 2221/36* (2013.01)

(56) References Cited

OTHER PUBLICATIONS

Search Report for European Patent Application No. 15164038, completed on Oct. 9, 2015.

* cited by examiner

[Fig. 1]
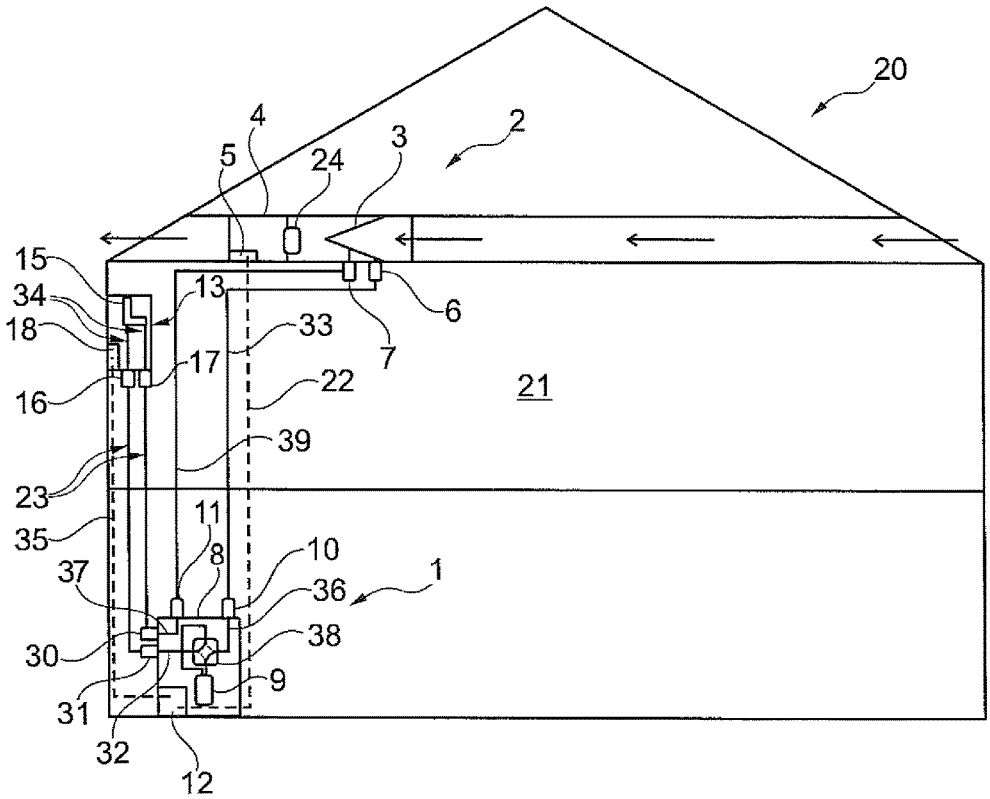

[Fig. 2]
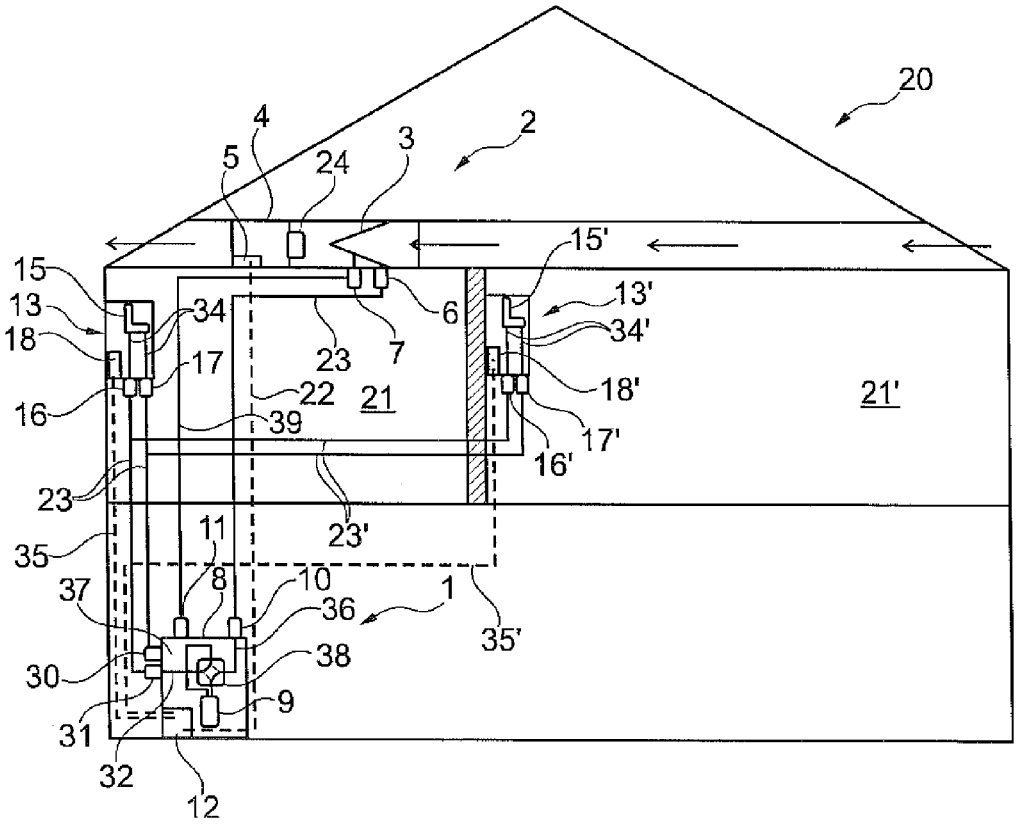

[Fig. 3]
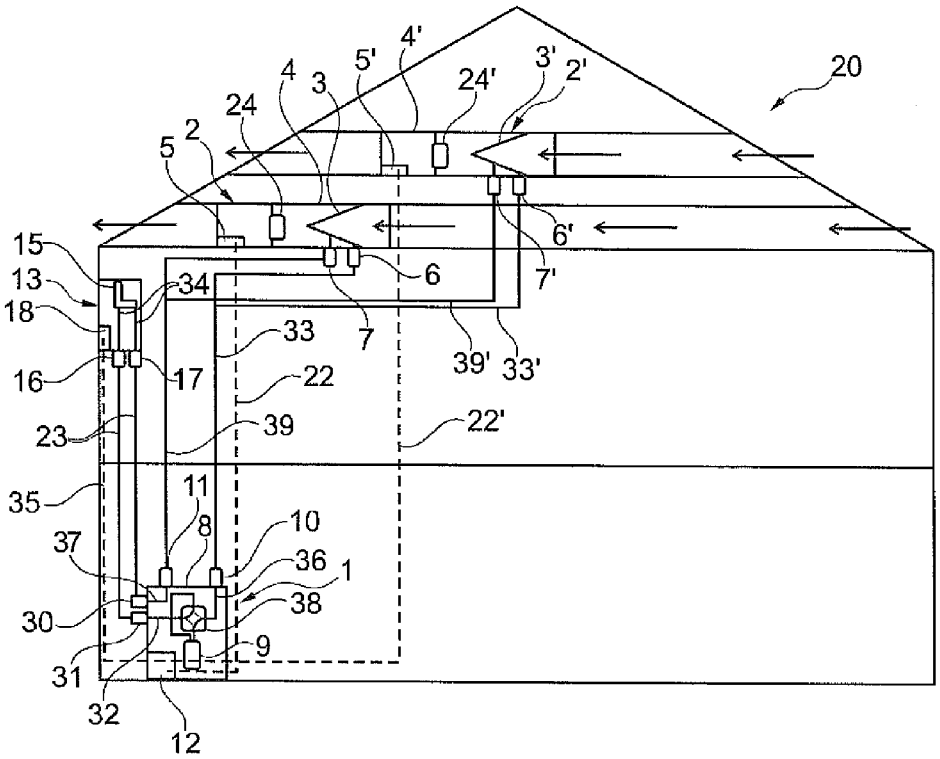

[Fig. 4]
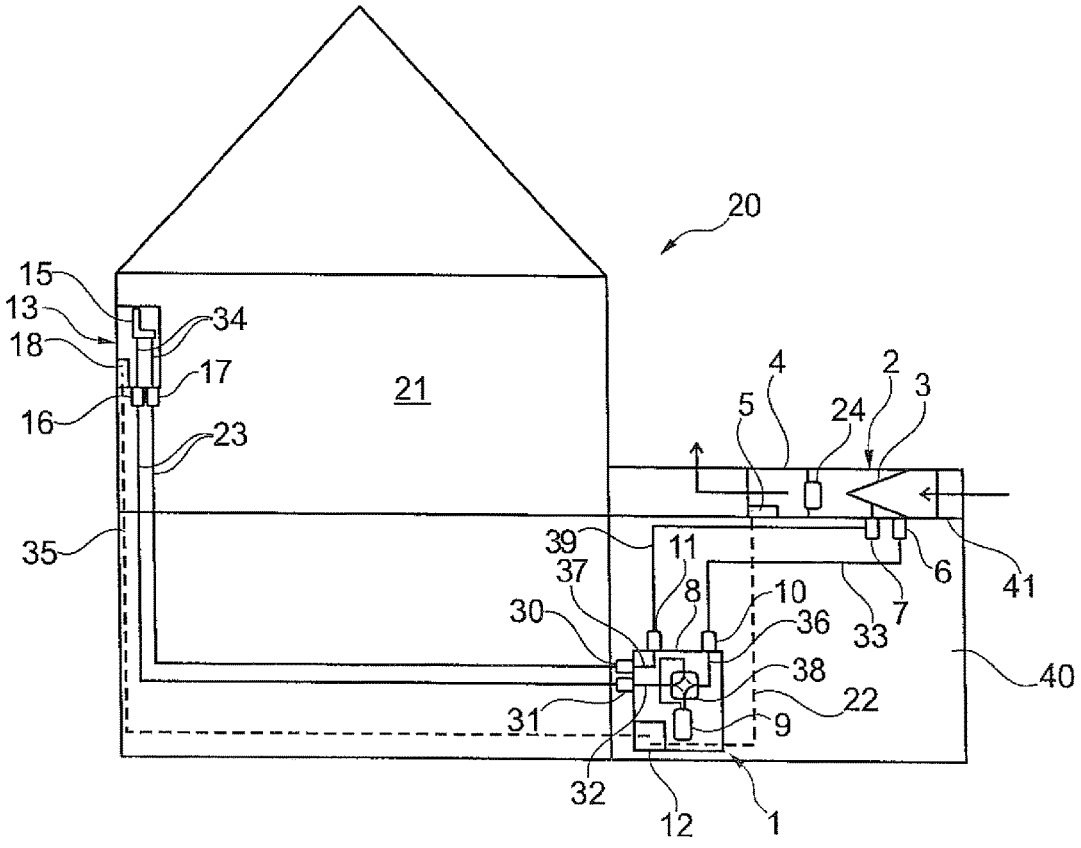

[Fig. 5]
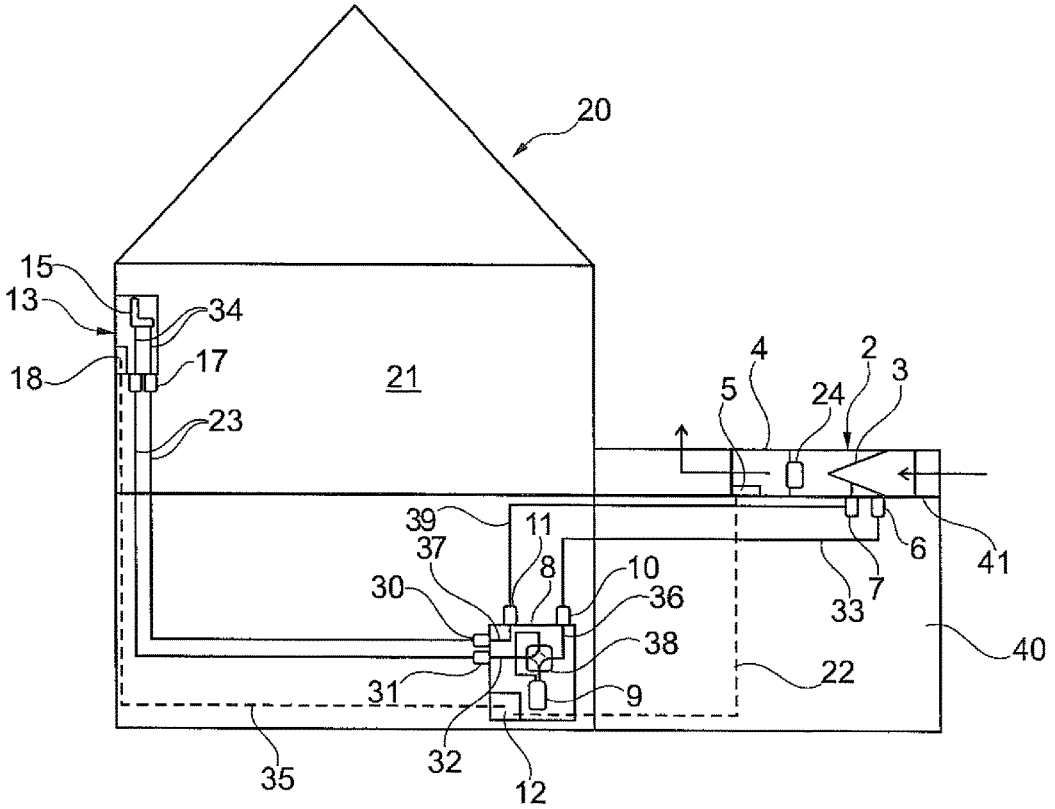

[Fig. 6]
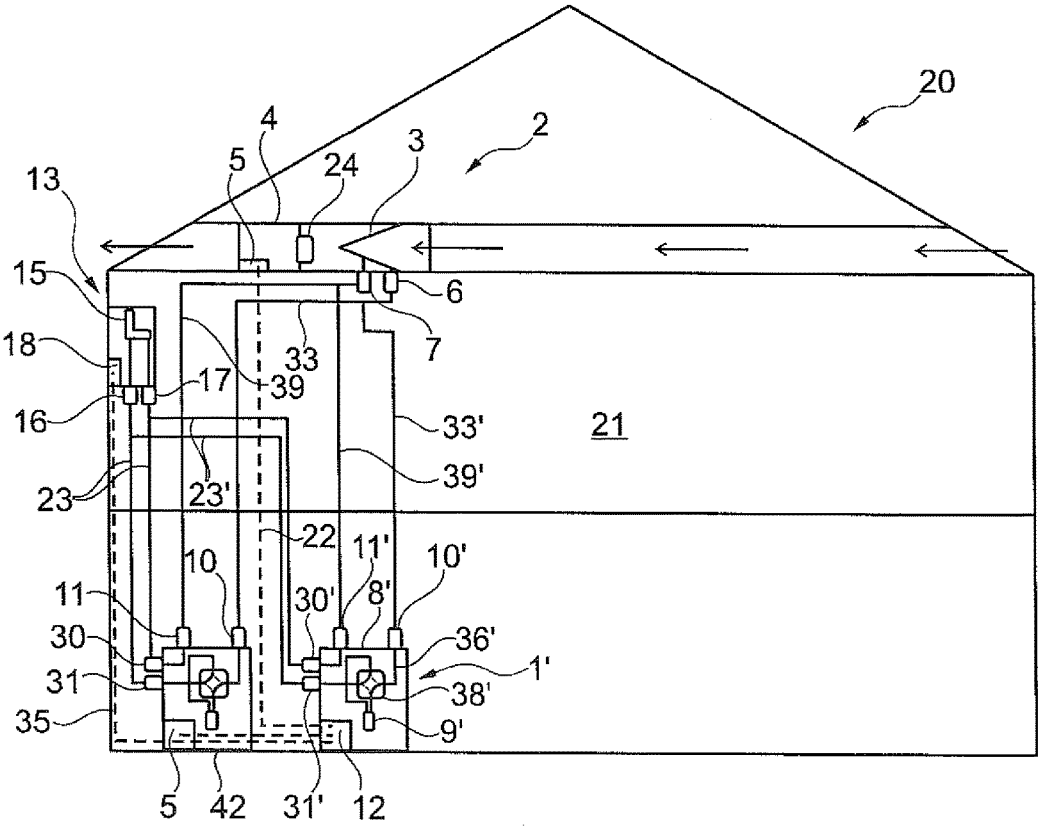

[Fig. 7]
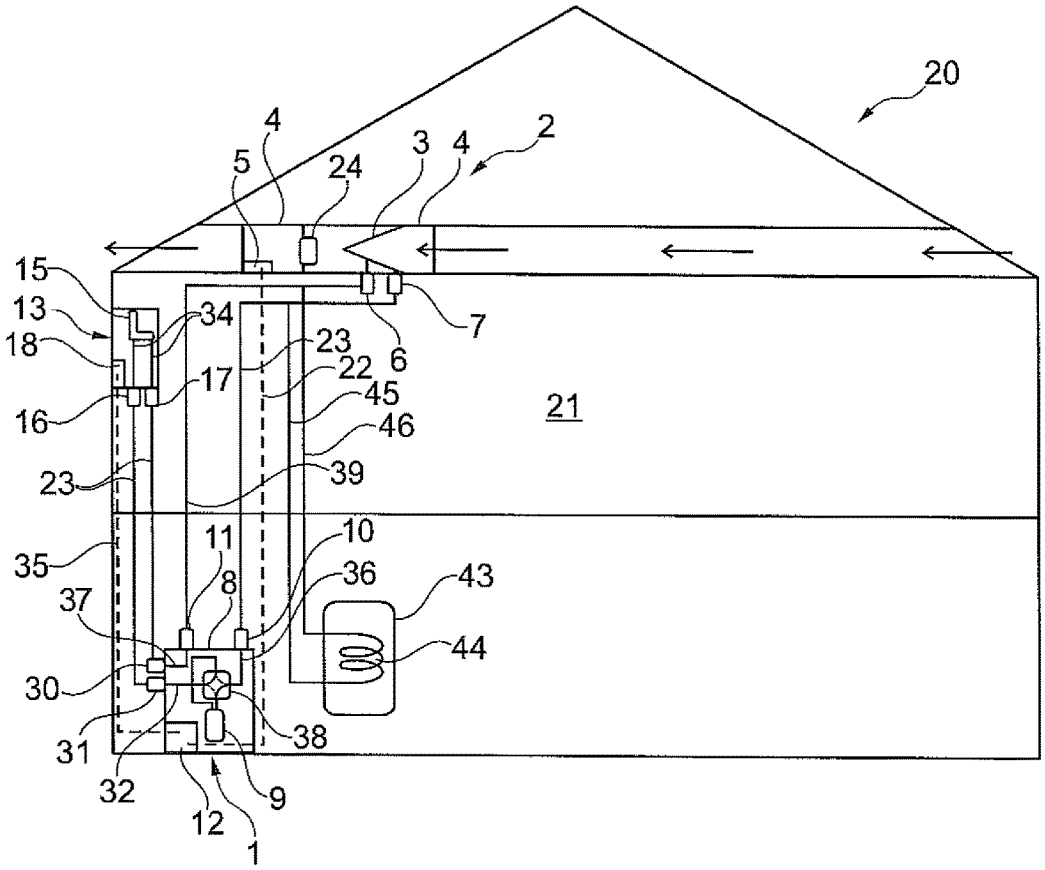

[Fig. 8]
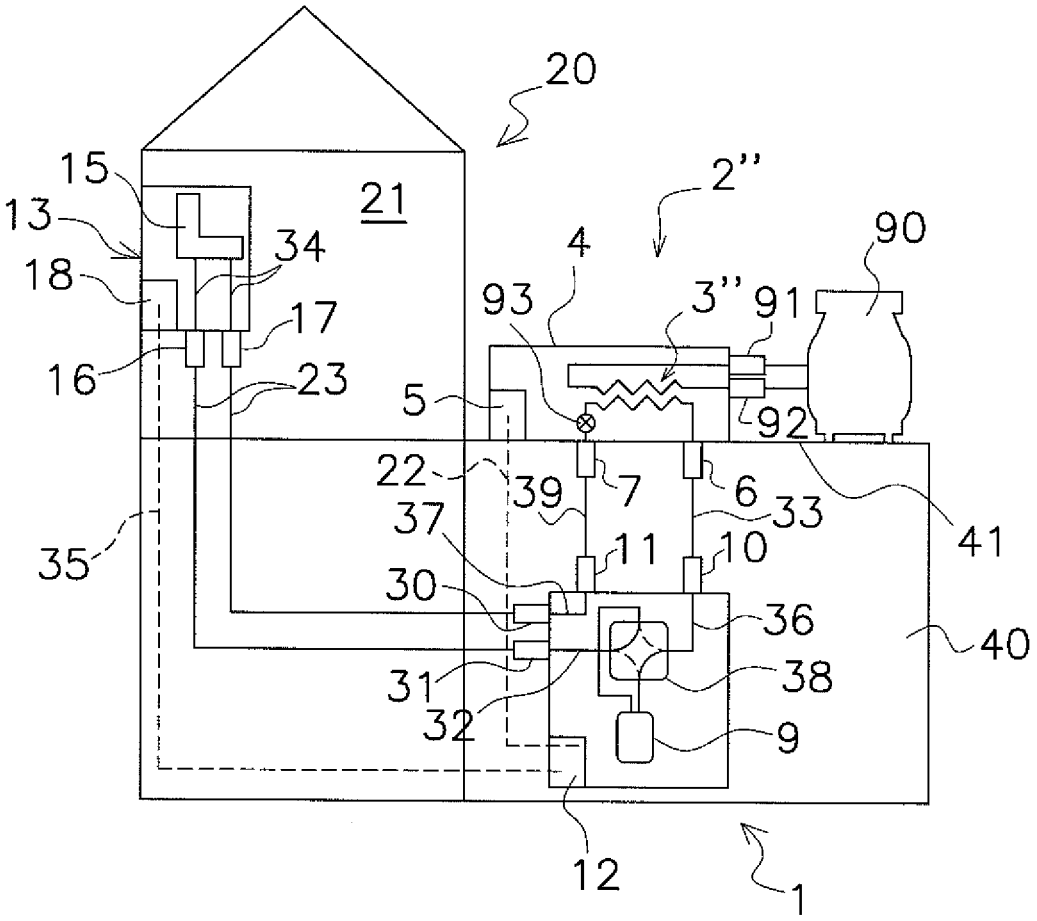

SET AND METHOD FOR ASSEMBLING A HEAT SOURCE UNIT

TECHNICAL FIELD

The present invention relates to air-conditioners, particularly to air-conditioners of the heat pump type. More particularly, the present invention relates to the assembly of a heat source unit of such air-conditioners at the site of the air conditioner.

BACKGROUND ART

Such air-conditioners are generally known in the art. In general, an air-conditioner of this type comprises an outdoor unit (heat source unit) comprising at least the compressor and the heat source heat exchanger of the air conditioner. Depending on the premises to be conditioned, different outdoor units having different capacity and/or using different heat sources (e.g., air, water, etc.) are available. These outdoor units are manufactured and offered on the market by a variety of companies including Daikin®. As the premises (e.g., a building) and, hence, the specifications for the air conditioners vary to a large extent, a plurality of different outdoor units need to be manufactured and be held available by the companies involving relatively high costs. In addition, the present outdoor units are relatively large and heavy so that the locations for installation of these outdoor units are very limited. Even further, in many cases, the optimum capacity and/or efficiency of the outdoor unit cannot be realized with the result of compromise with overcapacity and/or reduced efficiency of the air conditioner.

SUMMARY OF INVENTION

Technical Problem

The present invention aims at providing a set and method for assembling a heat source unit of an air conditioner at the site of the air conditioner that enables higher flexibility with respect to the installation location, to the specification such as the capacity as well as efficiency and/or to the selection of the heat source.

Solution to Problem

This object is achieved by a set and a method as described herein. Embodiments of the invention are detailed in the following description and the accompanying drawings.

According to an aspect, it is suggested to split the commonly used outdoor units (heat source units) into two modules, a heat source heat exchanger module (unit) and a compressor module (unit). This already provides more flexibility for the installation location because each unit as such is less heavy and more compact. The units may be placed at the same location or at different locations, indoor or outdoor. According to a further aspect, these modules (units) are assembled to constitute the heat source unit of an air conditioner only at the site (e.g. a building including space/-s to be conditioned) of the air conditioner and not at the manufacturing site. Depending on the specifications of the air conditioner and/or the intended/available heat source, different modules (units) and/or different number of modules (units) may be combined to meet the required specifications (e.g. of the space/-s to be conditioned in a building). As a result, the required specifications may be met more closely and the heat source unit may be adapted to the required capacity with high-efficiency.

According to a further aspect, a set for assembling a heat source unit of an air conditioner at the site of the air conditioner comprises a heat source heat exchanger module and a compressor module. The heat source heat exchanger module has a first casing, a heat source heat exchanger being disposed in the first casing. According to a first alternative, the heat source heat exchanger module comprises two compressor module ports preferably accessible from the outside of the first casing and fluidly communicated with the heat source heat exchanger, preferably via refrigerant piping. Alternatively (second alternative), the heat source heat exchanger module comprises an indoor unit port instead of one of the compressor module ports for direct connection of one or more indoor units.

The compressor module has a second casing separate from the first casing. "Separate" in this context means that the casings represent separate assemblies or units and should not encompass that one casing is disposed within the other casing. Further, the compressor module comprises a compressor disposed in the second casing.

According to the first alternative above, two heat source heat exchanger module ports (first and second heat source heat exchanger module ports) are provided and preferably accessible from the outside of the second casing. A first heat source heat exchanger module port is fluidly communicated with the compressor again preferably by refrigerant piping. Additionally, two indoor unit ports are provided which are preferably also accessible from the outside of the second casing. One of the indoor unit ports (first indoor unit port) will be communicated with the second heat source heat exchanger module port by refrigerant piping. The other of the indoor unit ports (second indoor unit port) will be fluidly connected to the compressor preferably by refrigerant piping. Accordingly, the connection between the heat source heat exchanger module and the at least one indoor unit may be looped through the second casing by connecting the heat source heat exchanger module to the second heat source heat exchanger module port and the one or more indoor units to the first indoor unit port which are fluidly connected by refrigerant piping. Further, the compressor is fluidly connected to the heat source heat exchanger module and particularly the heat source heat exchanger using the first heat source heat exchanger module port and to the one or more indoor units using the second indoor unit port.

According to the second alternative, the compressor module comprises one indoor unit port and one heat source heat exchanger module port. The indoor unit port will be fluidly communicated using a refrigerant piping to the compressor as will the one heat source heat exchanger module port.

As aforesaid, the compressor module and the heat source heat exchanger module may be fluidly communicated using the compressor module port(-s) and the heat source heat exchanger module port(-s) and an appropriate refrigerant piping for connecting the ports. Thus the heat source heat exchanger module may either directly be connected to one or more indoor units/modules (second alternative) or via the compressor module using one of the two compressor module ports at the heat source heat exchanger module, the second heat source heat exchanger module port and the first indoor unit port and appropriate refrigerant piping for connecting the ports (first alternative).

Moreover, a main board is provided which comprises a control logic of the air conditioner and a first electric connector. Each of the aforesaid modules has a circuit board wherein one of the circuit boards may be the main board. Yet, the main board may also be provided separately from the two modules. Each circuit board comprises a second electric connector, except for the case in which the circuit board is the main board which already comprises the first electric connector. Furthermore, the circuit boards are configured for data communication with the main board upon electrical connection of the circuit board/-s and the main board via the first and second electrical connectors.

According to one preferred embodiment mentioned previously, the circuit board of the compressor module is the main board.

Furthermore and in order to increase flexibility of the set regarding capacity and efficiency it may be advantageous to provide plural of said heat source heat exchanger modules and/or plural of said compressor modules, wherein each of the modules has said circuit board. As described previously, one of the pluralities of modules may of course comprise the main board instead of the circuit board.

According to one aspect, it is preferable that the main board is configured to automatically recognize the number and/or kind of modules connected to the main board via their circuit boards, i.e. the circuit boards of the respective modules. This provides for an easy installation according to the plug and play principle.

Alternatively the main board may comprise a switch or a plurality of switches, an input device such as a keyboard, a touchscreen or an electrical interface to for example connect an input device in order to manually adjust the number and/or kind of modules connected to the main board via their circuit boards. Another possibility may be to use dip switches and pushbuttons with seven segment or LED indicators.

A further aspect is the method for assembling a heat source unit of an air conditioner at a site of the air conditioner using a set as described above. In particular, the method includes the step of selecting the number of compressor modules and heat source heat exchanger modules required to obtain the capacity and/or efficiency of the heat source unit needed for the intended air conditioner/premises. This could mean that depending on the circumstances of the premises (for example of the building and or the spaces to be conditioned, the environmental conditions) the required specifications of the air conditioner are calculated. Based on the result of the calculation, the number of the compressor modules and heat source heat exchanger modules and/or the kind of heat source heat exchanger module is selected. Subsequently, the selected modules are fluidly communicated by attaching refrigerant piping via the compressor and heat source heat exchanger ports as explained above. Even further, the circuit boards of the selected modules are electrically connected using the first and second electric connectors.

Upon start of the system or upon electrical connection of the modules, the main board may automatically recognize the number and/or kind of selected modules as described above.

Alternatively, the method may comprise the additional step of manually inputting the number and/or kind of selected modules upon electrical connection.

Further features and effects of the heat source unit may be obtained from the following description of embodiments. In the description of these embodiments reference is made to the accompanying drawings.

BRIEF DESCRIPTION OF DRAWINGS

FIG. 1 is a schematic diagram showing an air conditioner implementing a heat source heat exchanger module and a compressor module to constitute a heat source unit according to first application;

FIG. 2 is a schematic diagram showing an air conditioner implementing a heat source heat exchanger module and a compressor module to constitute a heat source unit according to second application;

FIG. 3 is a schematic diagram showing an air conditioner implementing a heat source heat exchanger module and a compressor module to constitute a heat source unit according to third application;

FIG. 4 is a schematic diagram showing an air conditioner implementing a heat source heat exchanger module and a compressor module to constitute a heat source unit according to fourth application;

FIG. 5 is a schematic diagram showing an air conditioner implementing a heat source heat exchanger module and a compressor module to constitute a heat source unit according to fifth application;

FIG. 6 is a schematic diagram showing an air conditioner implementing a heat source heat exchanger module and a compressor module to constitute a heat source unit according to sixth application;

FIG. 7 is a schematic diagram showing an air conditioner implementing a heat source heat exchanger module and a compressor module to constitute a heat source unit according to seventh application; and FIG. 8 is a schematic diagram showing an air conditioner implementing a heat source heat exchanger module and a compressor module to constitute a heat source unit according to eighth application.

DESCRIPTION OF EMBODIMENTS

FIG. 1 shows a first example of an air conditioner that is assembled using a set and a method as previously described.

The air conditioner comprises a compressor module 1 and a heat source heat exchanger module 2 which together constitute a heat source unit.

The heat source heat exchanger module 2 is configured to use outside air as the heat source. The heat source heat exchanger module 2 comprises a heat exchanger 3 disposed in a casing 4 (first casing) and flown through by the outside air as indicated by the arrows in FIG. 1. The air flow is induced by one or more fans 24. Moreover, the heat exchanger 3 is fluidly connected or communicated to a first and second compressor module port 6, 7 preferably accessible at the outside of the casing 4 by refrigerant piping (lines in FIG. 1 connecting the heat exchanger 3 and the ports 6, 7, respectively). The heat source heat exchanger module 2 may further comprise a main expansion valve (not shown) of the refrigerant circuit of the air conditioner disposed in one of the lines connecting the ports 6, 7 and the heat exchanger 3, particularly the line connecting the port 7 and the heat exchanger 3. Further, a printed circuit board 5 is contained in the casing 4 having a second electrical connector (not shown).

The compressor module 1 comprises a casing 8 (second casing) separate from the first casing 4. A compressor 9 is contained in the casing 8 and fluidly connected or communicated to a first heat source heat exchanger port 10 by refrigerant piping 36 via a four-way valve 38. The 4-way valve 38 of the refrigerant circuit serves to switch between the cooling and heating operation of the air conditioner if desired or for defrosting operation. Further, the compressor 9 is fluidly connected or communicated to a first indoor unit port 31 by refrigerant piping 32 via the four-way valve 38.

Furthermore, a second heat source heat exchanger module port 11 is provided at the compressor module 1 and preferably accessible from the outside of the casing 8. The second heat source heat exchanger module port 11 is fluidly connected or communicated to a second indoor unit port 30 by refrigerant piping 37. Both, the first and second indoor unit ports 30, 31 are preferably provided at the casing 8 and more preferably accessible from the outside of the casing 8.

Furthermore, the compressor module 1 comprises a main board 12 as its circuit board and comprising a control logic of the air conditioner. The main board 12 comprises a plurality of first electrical connectors (not shown).

In addition, one indoor unit 13 is provided having a casing 14 (third casing) separate from the first and second casing 4, 8. The indoor unit 13 has an indoor heat exchanger 15 which is fluidly communicated to a first compressor module port 16 and a second compressor module port 17 both preferably accessible from the outside of the casing 14 by refrigerant piping 34. Moreover, the indoor unit 13 comprises a printed circuit board 18. The printed circuit board 18 has a second electrical connector (not shown).

When installing the air conditioner shown in FIG. 1, the installer calculates the needed capacity with the intended efficiency in mind and required for air-conditioning the premises 20 in view of the expected environmental conditions such as outdoor temperature, humidity, etc. In the present embodiment the installer then selects from a set one compressor module 1 and one heat source heat exchanger module 2 as well as one indoor unit 13 to meet the specifications resulting from the calculation.

After having installed the modules 1 and 2 at the respective locations (in this particular example, the compressor module 1 is installed on the floor of the basement of the building and the heat source heat exchanger module 2 is mounted in the ceiling under the roof), the heat source heat exchanger 3 and the compressor 9 are fluidly connected by means of refrigerant piping 33 using the compressor module port 6 and the heat source heat exchanger module port 10. In addition, the heat source heat exchanger module 2 and more particularly the heat exchanger 3 is connected to the compressor module 1 using the compressor module port 7 and the heat source heat exchanger module port 11 by refrigerant piping 39.

Furthermore, the indoor unit 13 is mounted in the space 21 to be conditioned. The indoor heat exchanger 15 of the indoor unit 13 is then fluidly communicated or connected via ports 16, 17 by refrigerant piping 23 to the indoor unit ports 30, 31 of the compressor module 1. Thereby the heat exchanger 3 and the indoor heat exchanger 15 are fluidly connected by means of the port 17, the refrigerant piping 23, the port 30, the refrigerant piping 37, the port 11, the refrigerant piping 39 and the port 7.

Accordingly, a refrigerant circuit is realized.

In addition the main board 12 and the printed circuit board 5 are electrically connected by electrically connecting an electrical line (dotted line in the drawings) 22 with an electrical connector to the second electrical connector of the printed circuit board 5 and another electrical connector to the first electrical connector of the main board 12.

In addition, the printed circuit board 18 of the indoor unit 13 is electrically connected to the main board 12 using an electrical line 35 with electrical connectors at both ends electrically connecting to the second electrical connector of the printed circuit board 18 and one of the first electrical connectors of the main board 12.

The main board 12 and the printed circuit boards 5, 18 are configured for data communication, such as exchange and detection of analog/digital data and ON/OFF signals.

Upon start of the system the main board 12 automatically recognizes the number of modules 1, 2 and 13 attached to the main board 12 and also the kind of the modules. Subsequently, the main board may select from a plurality of preinstalled programs to control the air conditioner such installed. Alternatively, the installer may input the required information and select a corresponding program via an interface.

FIG. 2 shows a second example of an air conditioner that is assembled using a set and a method as described herein. The difference between the embodiments in FIGS. 1 and 2 is the use of two indoor units 13 (a first indoor unit 13 and a second indoor unit 13') in the second embodiment.

When installing the air conditioner shown in FIG. 2, the installer calculates the needed capacity with the intended efficiency in mind and required for air-conditioning the premises 20 in view of the expected environmental conditions such as outdoor temperature, humidity, etc. In the present embodiment the installer then selects from a set one compressor module 1 and one heat source heat exchanger module 2 as well as two indoor units 13, 13' to meet the specifications resulting from the calculation.

In the second embodiment depicted in FIG. 2, the two indoor units 13, 13' are respectively disposed in separate spaces 21, 21' to be conditioned and connected to the compressor module in parallel. The configuration of the second indoor unit 13' is the same as that of the first indoor unit 13' described above with respect to FIG. 1, wherein the components of the second indoor unit 13' have been referred to by the same reference numerals added by "'". Hence and in order to avoid repetition the description thereof is omitted.

The ports 16', 17' of the second indoor unit 13' are connected to the refrigerant piping 23 by refrigerant piping 23' branching off the refrigerant piping 23 and connected to the ports 16', 17', respectively.

Further, the circuit board 18' of the second indoor unit 13' is electrically connected to the main board 12 using an electrical line 35' with electrical connectors at both ends electrically connecting to the second electrical connector of the printed circuit board 18' and one of the first electrical connectors of the main board 12.

As in the first embodiment, the system may automatically recognize the number and kind of modules or this information is manually input by the installer.

FIG. 3 shows a third example of an air conditioner that is assembled using a set and a method as described herein. The difference between the embodiments in FIGS. 1 and 3 is the use of two heat source heat exchanger modules (a first heat source heat exchanger module 2 and a second heat source heat exchanger module 2') in the third embodiment.

When installing the air conditioner shown in FIG. 3, the installer calculates the needed capacity with the intended efficiency in mind and required for air-conditioning the premises 20 in view of the expected environmental conditions such as outdoor temperature, humidity, etc. In the present embodiment the installer then selects from a set one compressor module 1 and two heat source heat exchanger modules 2, 2' as well as one indoor unit 13 to meet the specifications resulting from the calculation.

The second heat source heat exchanger module 2' of the third embodiment is identical to the first heat source heat exchanger module 2 of the first embodiment. As will be apparent from FIG. 3, the two heat source heat exchanger modules 2, 2' are connected in parallel to the refrigerant circuit. More particularly, the second heat source heat exchanger module 2' is connected with the ports 6', 7' and refrigerant piping 33' and 39' to the refrigerant piping 33 and 39 of the first heat source heat exchanger module 2, respectively. Thereby the second heat source heat exchanger module 2' is fluidly communicated and connected to the compressor module 1 and the indoor unit 13 in the same manner as the first heat source heat exchanger module 2.

Further, the circuit board 5' of the second heat source heat exchanger module 2' is electrically connected to the main board 12 using an electrical line 22' with electrical connectors at both ends electrically connecting to the second electrical connector of the printed circuit board 5' and one of the first electrical connectors of the main board 12.

As in the first embodiment, the system may automatically recognize the number and kind of modules or this information is manually input by the installer.

FIGS. 4 and 5 show fourth and fifth examples of air conditioners that are assembled using a set and a method as described herein. The difference between the embodiments in FIGS. 1 and 4 and FIGS. 1 and 5 is the positioning of the compressor module 1 and the heat source heat exchanger module 2. The remainder of the embodiments as well as the electrical connection and fluid communication of the modules is the same as in the first embodiment.

According to the embodiment in FIG. 4, the compressor module 1 is disposed on the floor of a vehicle hall or carport 40. The heat source heat exchanger module 2 is disposed in the ceiling 41 of the vehicle hall or carport 40.

According to the embodiment in FIG. 5, the compressor module 1 is disposed in the basement of a building. The heat source heat exchanger module 2 is disposed in the ceiling 41 of a vehicle hall or carport 40.

This particularly highlights the flexibility provided by the set suggested herein. Not only is this flexibility provided by the enablement to combine one or more of each unit to reach the required capacity and efficiency, but also by the enablement to position the units at different locations. These locations may for example be selected from the viewpoint of available space, ease of maintenance and/or sensibility of the location to noise.

FIG. 6 shows a sixth example of an air conditioner that is assembled using a set and a method as described herein. The difference between the embodiments in FIGS. 1 and 6 is the use of two compressor modules (a first compressor module 1 and a second compressor module 1') in the sixth embodiment.

When installing the air conditioner shown in FIG. 6, the installer calculates the needed capacity with the intended efficiency in mind and required for air-conditioning the premises 20 in view of the expected environmental conditions such as outdoor temperature, humidity, etc. In the present embodiment the installer then selects from a set two compressor modules 1, 1' and one heat source heat exchanger module 2 as well as one indoor unit 13 to meet the specifications resulting from the calculation.

The second compressor module 1' is configured identical to the first compressor module 1 as described in the first embodiment. In addition, the first and second compressor modules 1, 1' are connected in parallel. In particular, the ports 10', 11' of the second compressor module 1' are connected via refrigerant piping 33' and 39' to the refrigerant piping 33 and 39, respectively connecting the ports 10 and 11 of the first compressor module 1 to the ports 6, 7 of the heat source heat exchanger module 2. Accordingly, the ports 10', 11' of the second compressor module 1' are connected to the heat source heat exchanger module 2 in the same manner as the ports 10, 11 of the first compressor module 1.

In addition, the ports 30' and 31' of the second compressor module 1' are connected via refrigerant piping 23' to the refrigerant piping 23 connecting the ports 30, 31 of the first compressor module 2 to the ports 16, 17 of the indoor unit 13. As a result, the ports 30', 31' of the second compressor module 1' are connected to the indoor unit 13 in the same manner as the first compressor module 1.

In addition, the main board 12 of the sixth embodiment is disposed in the second compressor module 1'. Hence, the heat source heat exchanger module 2 or particularly its printed circuit board 5 is connected to the main board 12 via the electrical line 22 having an electrical connector at one end connecting to a second electrical connector of the printed circuit board 5 of the heat source heat exchanger module 2 and another electrical connector at the other end connecting to one of the first electrical connectors of the main board 12. The first compressor module 1 has a printed circuit board 5 electrically connected to the main board 12 via an electrical line 42. The electrical line 42 as well has an electrical connector at one and connecting to a second electrical connector of the printed circuit board 5 of the first compressor module 1 and another electrical connector at the other hand connecting to one of the first electrical connectors of the main board 12. The printed circuit board 18 of the indoor unit 13 is again connected to the main board 12 via an electrical line 35. The electrical line 35 has an electrical connector at one end connecting to a second electrical connector of the printed circuit board 18 of the indoor unit 13 and another electrical connector at the other end connecting to one of the first electrical connectors of the main board 12.

As in the first embodiment, the system may automatically recognize the number and kind of modules or this information is manually input by the installer.

FIG. 7 shows a seventh example of an air conditioner that is assembled using a set and a method as described herein. The difference between the embodiments in FIGS. 1 and 7 is the additional use of a domestic hot water tank 43 in the seventh embodiment.

In particular, a hot water tank 43 comprises a refrigerant loop 44 passing through the interior of the hot water tank 43 to heat water inside the hot water tank 43 used for tap water, etc. in a domestic household. The refrigerant loop 44 is connected via refrigerant piping 45 and 46 to the refrigerant piping 23 and 39 connecting the compressor module 1 to the heat source heat exchanger module 2 as described earlier. Accordingly, the heat of the refrigerant flown during cooling operation via the port 10 and the refrigerant piping 23 can be transferred via the refrigerant piping 45 and the refrigerant loop 44 to the water contained in the hot water tank 43 and thereby used to heat the domestic hot water. At the same time the refrigerant is cooled and condensed and may subsequently be transferred via the refrigerant piping 46 to the refrigerant piping 39 and later be used for cooling the space to be conditioned via the indoor unit 13. Accordingly even more flexibility can be achieved when installing the air conditioner in the premises 20.

The remainder of the seventh embodiment is the same as that of the first embodiment.

FIG. 8 shows an eighth example of an air conditioner that is assembled using a set and a method as described herein. The difference between the embodiments in FIGS. 4 and 8 is the use of a heat source heat exchanger module 2" that is configured to utilize water heat source.

The heat source heat exchanger module 2" is configured to use circulating water as the heat source in cooperation with a cooling tower 90, which serves to cool the water. The heat source heat exchanger module 2" comprises a water-refrigerant heat exchanger 3" disposed in a casing 4 (first casing). The water circulates through the water circuit, which includes the cooling tower 90, the first water port 91, the water-refrigerant heat exchanger 3", and the second water port 92. Moreover, the water-refrigerant heat exchanger 3" is fluidly connected or communicated to a first and second compressor module port 6, 7 preferably accessible at the outside of the casing 4 by refrigerant piping. The heat source heat exchanger module 2" may further comprise a main expansion valve 93 of the refrigerant circuit of the air conditioner disposed in one of the lines connecting the ports 6, 7 and the water-refrigerant heat exchanger 3", particularly the line connecting the port 7 and the water-refrigerant heat exchanger 3". Further, a printed circuit board 5 is contained in the casing 4 having a second electrical connector (not shown).

For cooling operation, the cooling tower 90 causes the circulating water to release heat so that the water-refrigerant heat exchanger 3" can cool the refrigerant to be condensed by means of the circulating water.

For heating operation, a boiler equipment (not shown) to heat the circulating water may be employed in addition to the cooling tower 90.

The remainder of the eighth embodiment is the same as the fourth embodiment.

Even though some embodiments have been described above, it is to be understood, that any number of heat source heat exchanger modules 2 and/or compressor modules 1 and any number of indoor units 13 may be used and connected and depending on the circumstances particularly the needed capacity and the environmental conditions. Further, the hot water tank 43 described in the seventh embodiment may also be incorporated in one of the embodiments 1 to 6 and 8.

Moreover, the heat source heat exchanger module 2" and the cooling tower 90 described in the eighth embodiment may be applied to the previous embodiments 1 to 7, optionally together with the boiler equipment. In addition it is to be understood in sense of the present application than an electrical line may be separated into a plurality of lines connected to each other to each other.

The invention claimed is:

1. An air conditioner, comprising:

at least one heat source heat exchanger module having a first casing and a heat source heat exchanger, the first casing having installed thereon a compressor module port fluidly communicated with the heat source heat exchanger;

at least one indoor unit of the air conditioner, the at least one indoor unit including an indoor heat exchanger, at least one compressor module having a second casing separate from the first casing and a compressor, the second casing having installed thereon a heat source heat exchanger module port fluidly communicated with the compressor, and an indoor unit port configured to be fluidly communicated with one or more of the at least one indoor unit, each of which is external to the second casing, wherein each of the at least one heat source heat exchanger module is fluidly communicatable with one or more of the at least one compressor module via the compressor module port and the heat source heat exchanger module port; and wherein one of the at least one heat source heat exchange module, the at least one compressor, and the at least one indoor unit includes a main board comprising a control logic of the air conditioner and a first electric connector, wherein the others of the at least one heat source heat exchanger module, the at least one compressor module, and the at least one indoor unit has a circuit board comprising a second electric connector, the circuit boards being configured for data communication with the main board upon electrical connection of the circuit boards and the main board via the first connector and the respective second connectors.

2. The air conditioner according to claim 1, wherein the main board is a circuit board of one of the at least one compressor module.

3. The air conditioner according to claim 1, wherein the air conditioner satisfies at least one of the following conditions:

said at least one heat source heat exchanger module is comprised of a plurality of hear source heat exchanger modules in the air conditioner, each of said plurality of heat source heat exchanger modules having a printed circuit board, and said at least one compressor module is comprised of a plurality of compressor modules in the air conditioner, each of the plurality of compressor modules having a circuit board.

4. The air conditioner according to claim 3, wherein the main board is configured to perform the determination by automatically recognizing the number of modules and the kind of modules connected to the main board via their respective circuit boards.

5. The air conditioner according to claim 3, wherein the main board comprises a switch, an input device, or an electrical interface to perform the determination by allowing a user to manually adjust at least one of the number of modules and the kind of modules connected to the main board via their respective circuit boards.

6. The air conditioner according to claim 2, wherein the air conditioner satisfies at least one of the following conditions:

said at least one heat source heat exchanger module is comprised of a plurality of heat source heat exchangers modules in the air conditioner, each of said plurality of heat source heat exchanger modules having a printed circuit board, and said at least one compressor module is comprised of a plurality of compressor modules in the air conditioner, each of the plurality of compressor modules having a circuit board.

7. A method for assembling a heat source unit of an air conditioner at a site of the air conditioner, comprising the steps of:

selecting a number of compressor modules and heat source heat exchanger modules required to obtain at least one of a capacity and an efficiency of the heat source unit previously calculated for an intended air conditioner according to claim 3;

fluidly communicating the selected modules via the compressor and heat source ports;

electrically connecting the main board and the circuit board of at least one of the selected modules via the first and second electrical connectors.

8. The method for assembling a heat source unit of an air conditioner according to claim 7, wherein the main board automatically recognizes the number and the kind of selected modules.

9. The method for assembling a heat source unit of an air conditioner according to claim 7, further comprising the step of manually inputting at least one of the number and the kind of selected modules.

* * * * *